US005402493A

United States Patent [19]

Goldstein

[11] Patent Number: 5,402,493

[45] Date of Patent: Mar. 28, 1995

[54] ELECTRONIC SIMULATOR OF NON-LINEAR AND ACTIVE COCHLEAR SPECTRUM ANALYSIS

[75] Inventor: Julius L. Goldstein, St. Louis, Mo.

[73] Assignee: Central Institute For The Deaf, St. Louis, Mo.

[21] Appl. No.: 970,141

[22] Filed: Nov. 2, 1992

[51] Int. Cl.[6] ..... H04R 25/00

[52] U.S. Cl. ..... 381/68.2; 381/60

[58] Field of Search ..... 128/746; 73/585; 381/60, 68.2, 68.4

[56] References Cited

U.S. PATENT DOCUMENTS 3,989,904 11/1976 Rohrer et al. .

4,536,844 8/1985 Lyon ..... 381/68.2

OTHER PUBLICATIONS

*Introduction to Distributed Amplification* by Harry Stockman, Second Editioin, 1956, Preface p. vii.

Article entitled *Digital Signal Processing With the TMS320C25* by Rulph Chassaing et al, published by Wiley-Interscience Publication, 1990, pp. xiii-14.

Article entitled *Micromechanical Models of the Cochlea* by Jont Allen et al, published in *Physics Today*, Jul. 1992, pp. 40-47.

Article entitled *Adequacy of auditory models to predict human internal representation of speech sounds* by Oded Ghitza, published in the *J. Accoust. Soc. Am.* 93 (4), Apr. 1993, pp. 2160-2171.

Article entitled *Electronic Amplifier Circuits* - Theory and Design, by Joseph M. Pettit et al, published by McGraw-Hill, New York, 1961, pp. 147-163.

*Primary Examiner*—Forester W. Isen

*Attorney, Agent, or Firm*—Rogers, Howell & Haferkamp

[57] ABSTRACT

A model simulating cochlear spectrum analysis is disclosed which includes a pair of matched all pole lattices interconnected by a plurality of tip couplers providing non-linear distributed bilateral signal processing. One of the lattices along with the tip couplers corresponds to the organ of Corti found in the cochlea and the second lattice corresponds to the basilar membrane also found in the cochlea such that the model provides a striking resemblance in structure to the physical properties of the cochlea itself. With the cochlea model disclosed, distortion products and otoacoustic emissions are simulated. An intermediate model is also disclosed which provides bilateral signal processing but lacks distributed amplification.

19 Claims, 7 Drawing Sheets

ELECTRONIC SIMULATOR OF NON-LINEAR AND ACTIVE COCHLEAR SPECTRUM ANALYSIS

BACKGROUND AND SUMMARY OF THE INVENTION

Many researchers, including the inventor herein, have spent many years trying to understand the biophysical mechanisms of the human ear to understand how the human ear works and also to help in developing a module, which may be physically constructed, which duplicates or simulates the operation of the ear. Many theories and models have been developed over the years which have progressed this development. The inventor herein has previously developed a biophysical model (Goldstein, J. L. "Modeling rapid waveform compression on the basilar membrane as multiple-band-pass-nonlinearity filtering", Hearing Research 49, 39–60) which sought to explain the biophysical mechanisms of the ear in terms of a multiple band pass non-linear input/output model for simulating the non-linear basilar membrane response. The approach in this prior model was to account for non-linear cochlear phenomena directly in terms of a mathematical model of I/O behavior rather than treating them as non-linear perturbations from a physically based linear theory. This basic model, and later models, incorporate two non-linearly interacting filter systems that simulate the two distinct non-linear regimes observed in all non-linear phenomena at low-to-moderate and moderate-to-high stimulus sound levels. While this prior model and theory represented a dramatic departure from the prior art in itself, and helped to advance the work on understanding the ear as it provided new direction, this model was not a complete answer in that it did not explain observed phenomena such as distortion products and otoacoustic emissions, or otherwise provide any understanding of the operation of the organ of Corti. Furthermore, the model did not fully address the function of the basilar membrane as the model structure does not reflect the known biophysical properties of the cochlea.

With the present invention (See Goldstein, J. L., *Changing Roles in the Cochlea: Bandpass Filtering by the organ of Corti and Additive Amplification of the Basilar Membrane*, paper 4aPP3 at 124th Meeting of the Acoustical Society of America, November 1992), the inventor has improved on his earlier model to bring it further in congruence with the known biophysical mechanisms of the ear, including most particularly the organ of Corti and basilar membrane, and has in the process achieved simulation of the heretofore unexplained distortion product and otoacoustic emissions. In an intermediate step, the inventor has added bilateral signal processing to his prior model to more completely simulate the two signaling channels responsible for the "tips" and "tails" of Cochlear tuning curves. This bilateral processing potentiates extension of the model to other phenomena, including combination tones (distortion products) and otoacoustic emissions. This intermediate step takes advantage of non-linear feedback while the full invention adds distributed amplification. This distributed amplification provides for the non-linear addition of many signals from tip sources which are believed to function similarly to the organ of Corti. These organ of Corti filters, or tip sources, are connected at different locations along a filter-bank spectrum analyzer (a corollary to the outer hair cells and adjoining structures) and are non-linearly added through a propagating medium (a corollary to the basilar membrane) to provide distributed amplification. This model thus helps explain the non-linear input/output characteristic as observed by others in the basilar membrane mechanical response in the human ear.

There are several additional features of the present invention, including a "zoom" capability, a sensitivity adjustment, and efferent neural control simulation. As explained in greater detail below, the present invention includes a pair of matched all pole lattices with a plurality of tip couplers tapped into each lattice and interconnecting them at chosen "center frequencies". A scaling factor, or alpha, may be induced at any frequency to alter the response at that frequency and thereby match the model's output to any particular human ear output. Additionally, an efferent bias control, which is ordinarily set to zero, may also be used to scale the throughput of any one or more tip couplers to simulate the brain's ability in humans to "tune out" undesirable sounds or simulate "listening without hearing" as experienced in humans. Choosing the number of tip couplers (and hence the length of the matched lattices), and the "center frequencies" of each of the tip couplers permits the model builder to focus on any one or more range of frequencies for measurement with the model. Additionally, the model accommodates the use of 12,000 tip modules which corresponds to the full complement of outer hair cells believed to be contained and operative in the organ of Corti, to thereby provide a full representation and simulation of the frequency range of the human ear. As this may be cumbersome or undesirable, a fewer number of tip couplers may be used and may be focused over a chosen portion of the frequency range of hearing to thereby minimize cost and complexity of the model while still simulating with great accuracy the desired response frequencies.

While the principal advantages and features of the present invention have been described above, a more complete and thorough understanding of the invention may be attained by referring to the drawings and description of the preferred embodiment which follow.

Figure 5:
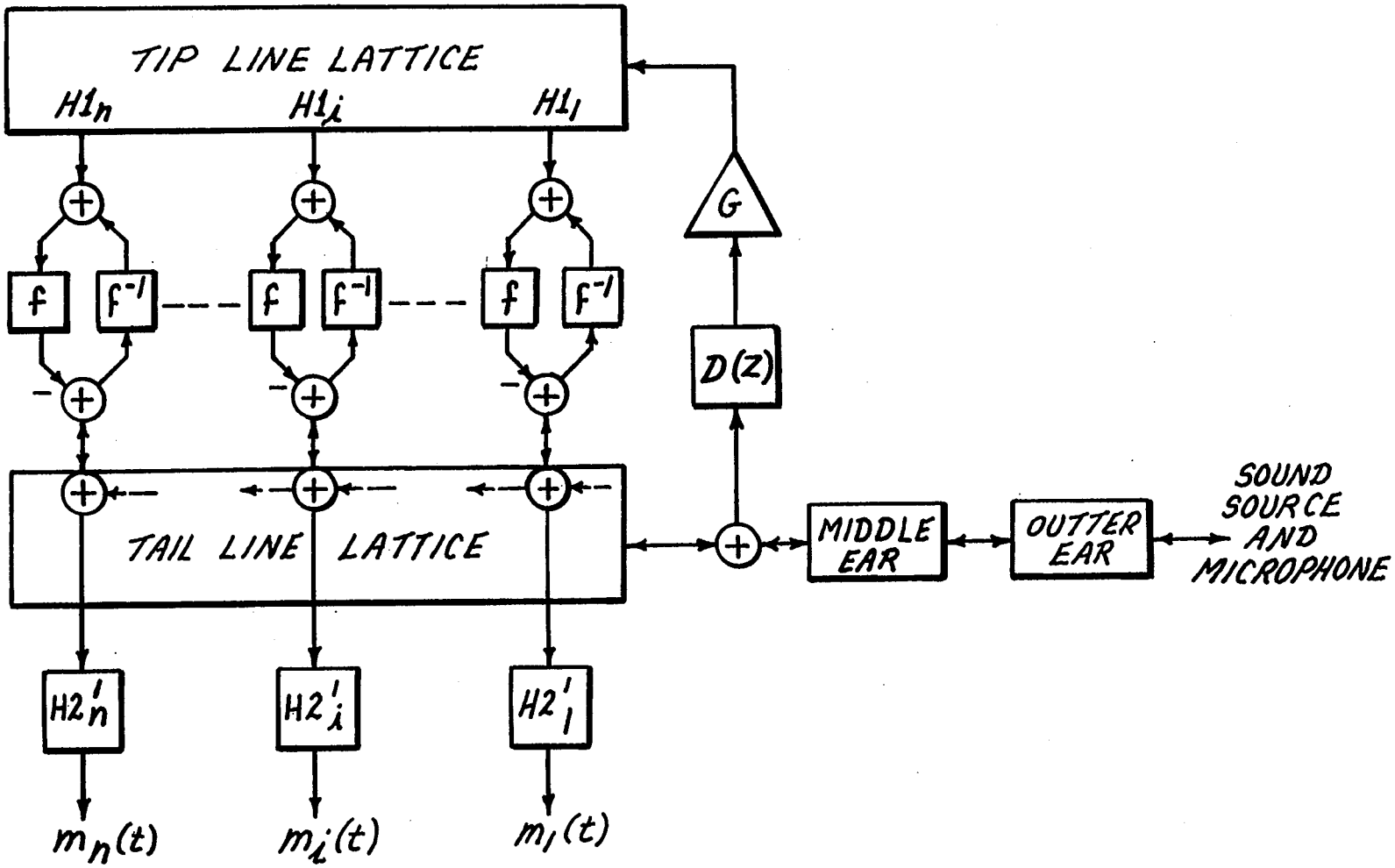
FIG. 5 is a schematic of the present invention detailing the non-linear cochlear simulator.
Figure 8:
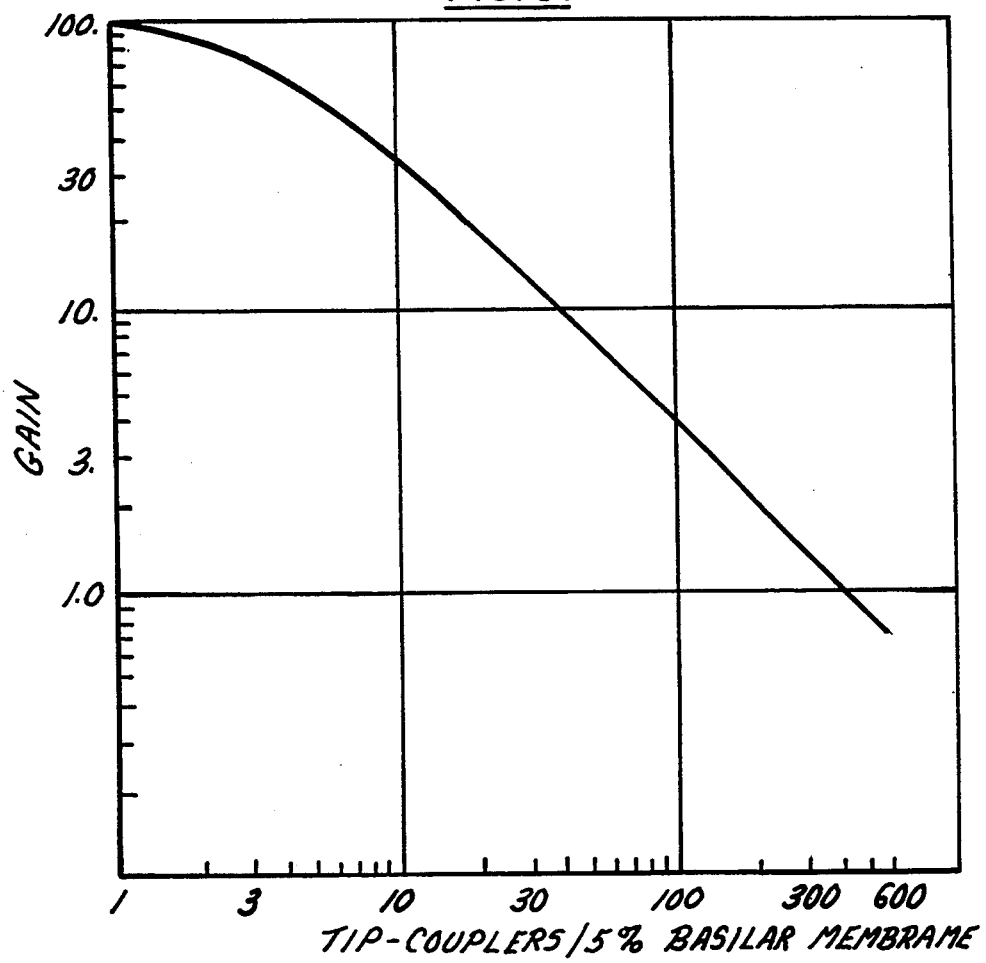
Figure 9:
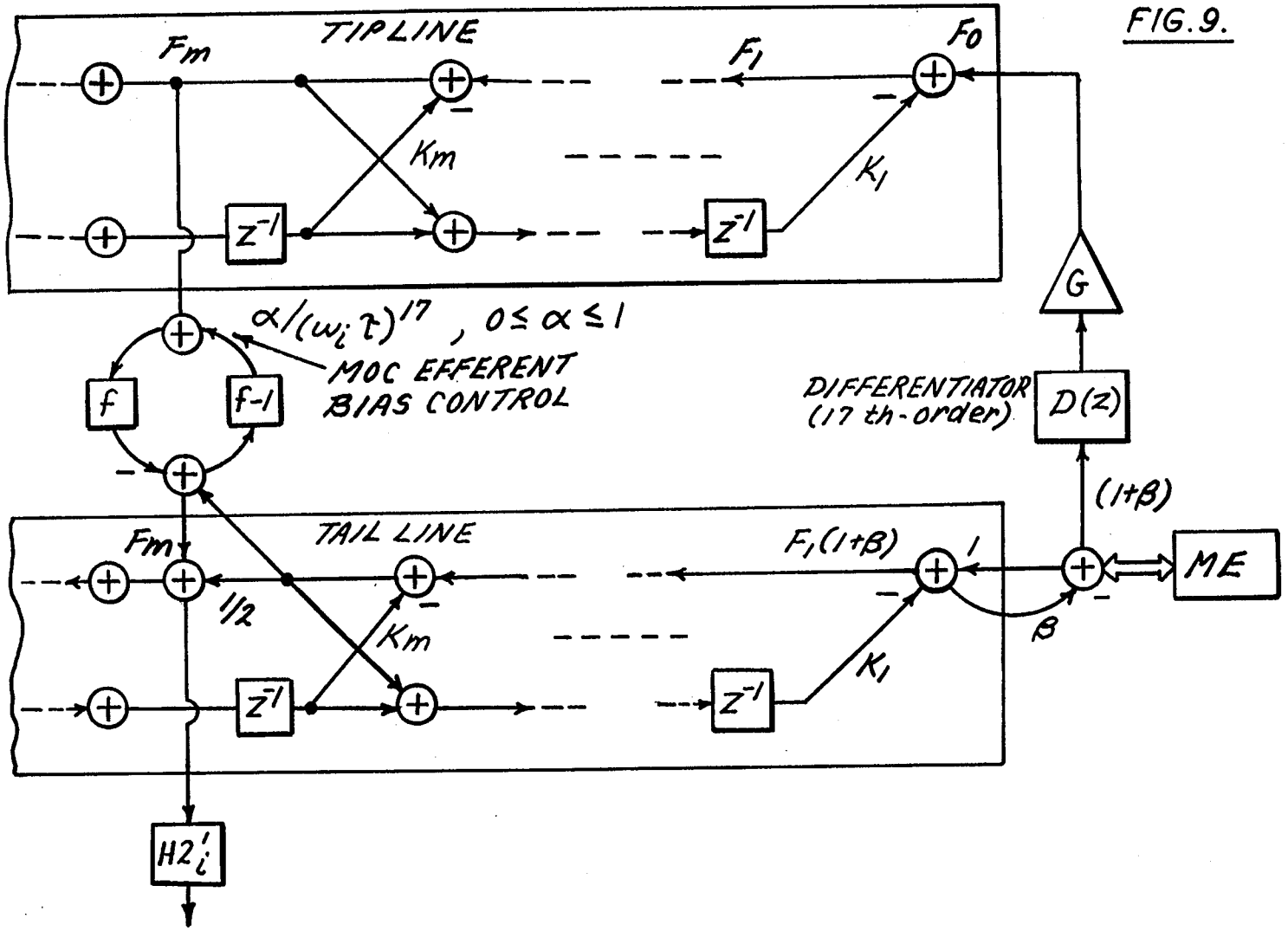

FIGS. *7a* and *7b* are schematic diagrams detailing lattice construction as utilized in the present invention;

FIG. 8 is a graph providing the relationship between tip coupler density and tip preamplifier gain; and FIG. 9 is a partial schematic of the model shown in FIG. 5 and further detailing the interconnection between the tip line lattice and tail line lattice through the tip couplers.

DETAILED DESCRIPTION OF THE PREFERRED EMBODIMENT

Figure 1:
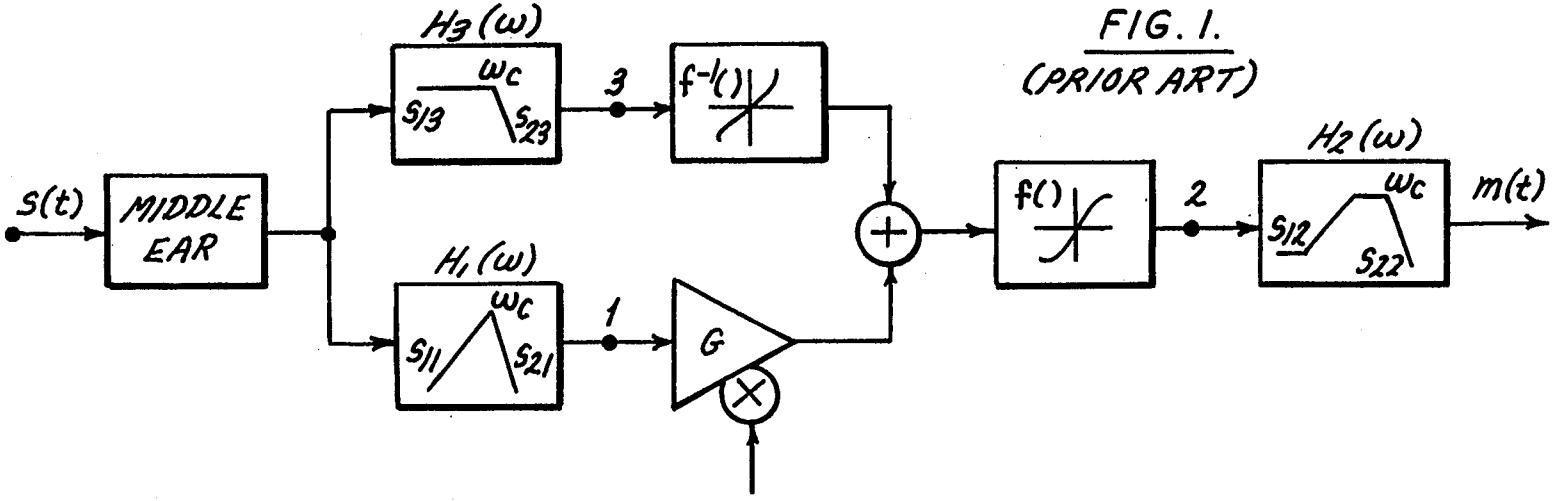
FIG. 1. (PRIOR ART)
FIG. 1 is a schematic diagram representing the inventor's prior art model for simulating human ear response.

As shown in FIG. 1, the inventor herein has previously developed a model for explaining and simulating the cochlear response of the human ear. In essence, the model of FIG. 1 is characterized by a unilateral non-linear signal processing of two signaling channels responsible for the "tips" and "tails" well demonstrated in the literature as being measured in cochlear frequency tuning curves. Using this prior art, cochlear spectrum analysis would be approximately simulated by a bank of independent non-linear filters, each tuned to a different audible frequency. Further details of the specific operation and functional components of the model of FIG. 1 are described in the inventor's prior article referenced above. However, it is important to note that signal processing occurs from left to right as shown in FIG. 1 and there is no feedback loop nor counter signal flow demonstrated by the model. Nevertheless, the model is successful in simulating sound level dependent non-linear cochlear frequency analysis as measured in many psycho-physical and biophysical experiments.

Figure 2:
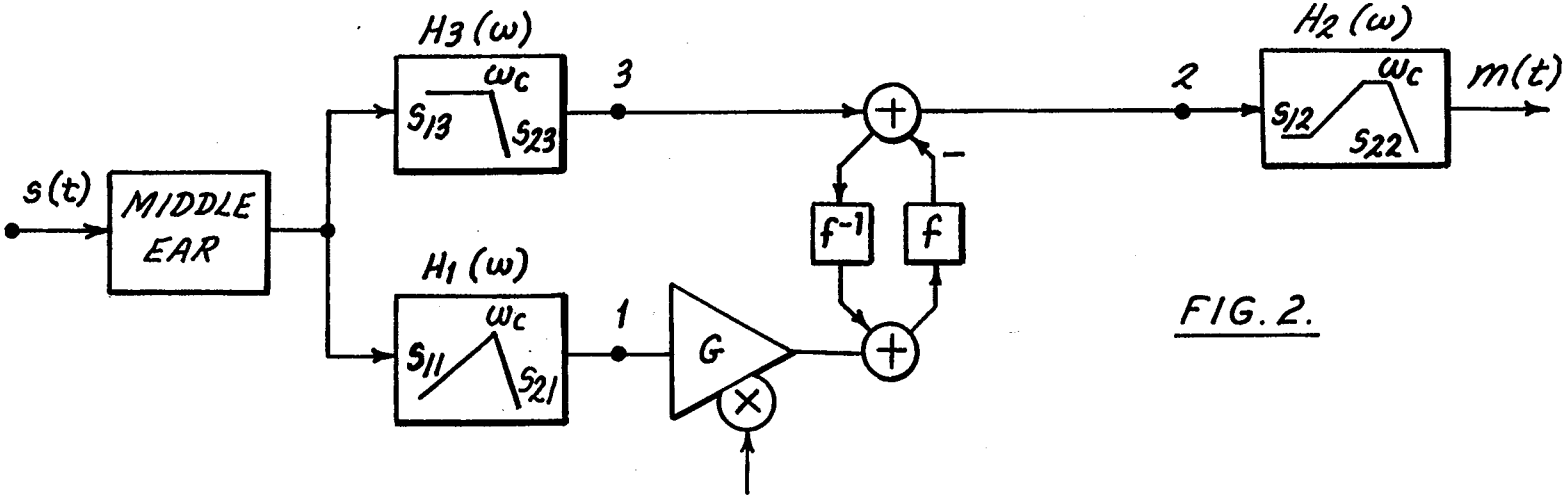
FIG. 2 is a first embodiment of the invention which includes bilateral signal processing in a model for simulating human ear response.

The inventor's further work has led to the development of the present invention which, in its first embodiment, incorporates bilateral signal processing by the alternate signal paths through the functions f and $f^{-1}$. This bilateral signal processing potentiates extension of the model such that it can be used to explain other phenomena not previously explainable with the model of FIG. 1, e.g. combination tones and otoacoustic emissions. As shown in FIG. 2, points 2 and 3 may be thought of as taps in a propagating medium, further identified in later developments as shown herein as the basilar membrane. The non-linear feedback loop through which the bilateral signal processing occurs, i.e. through the alternate branches of f and $f^{-1}$, provides non-linear addition of a signal from the unilateral tip source at point 1 therein with a signal on the propagating "tail medium" at point three as shown therein. With this modification to the model of FIG. 1, spectrum analysis by independent nonlinear filters is retained and there is no interaction suggested between apically propagating responses. In other words, the low pass filter H3 admits low frequency signals through the middle ear and the tuned filter H1 admits sounds at the center frequency $\omega_c$ and its response is non-linearly processed, as explained, with an output response filtered through band pass filter H2. Interaction between non-linear filters tuned to different frequencies is not suggested or explained in the model and schematic of FIG. 2.

Figure 3:
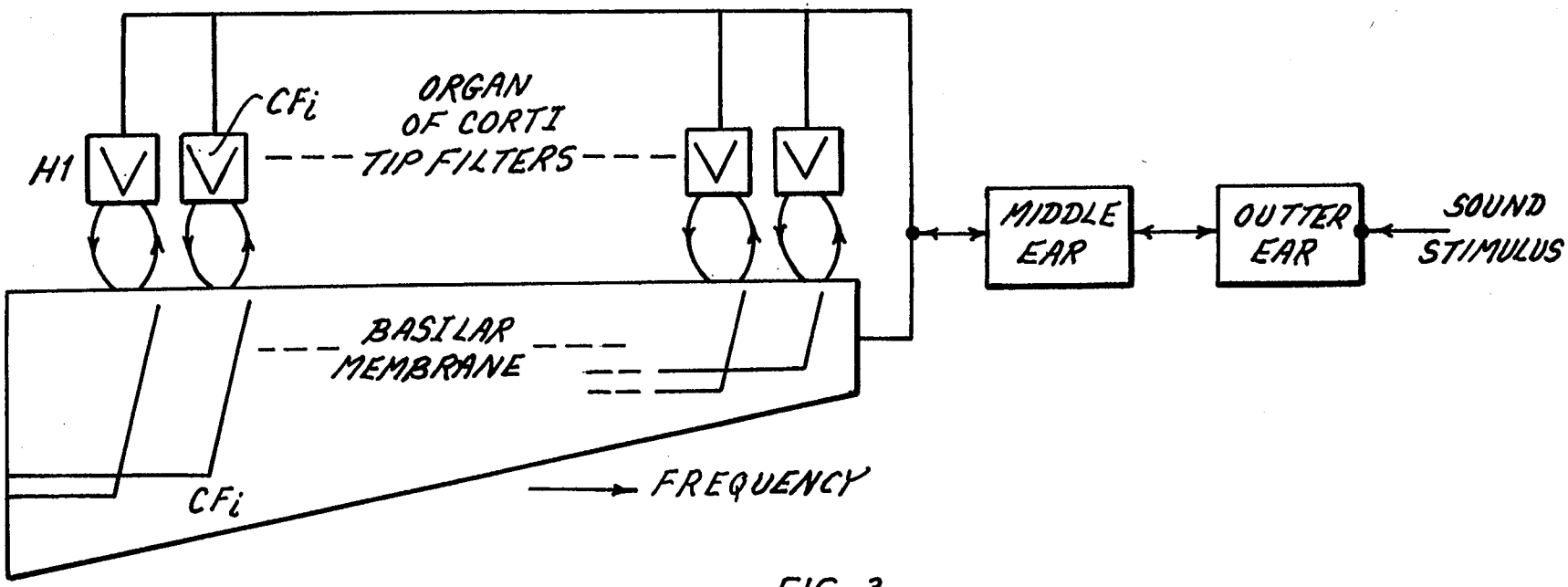
FIG. 3 is a schematic depicting the inventor's interpretation of the biological function of the cochlea.
Figure 6:
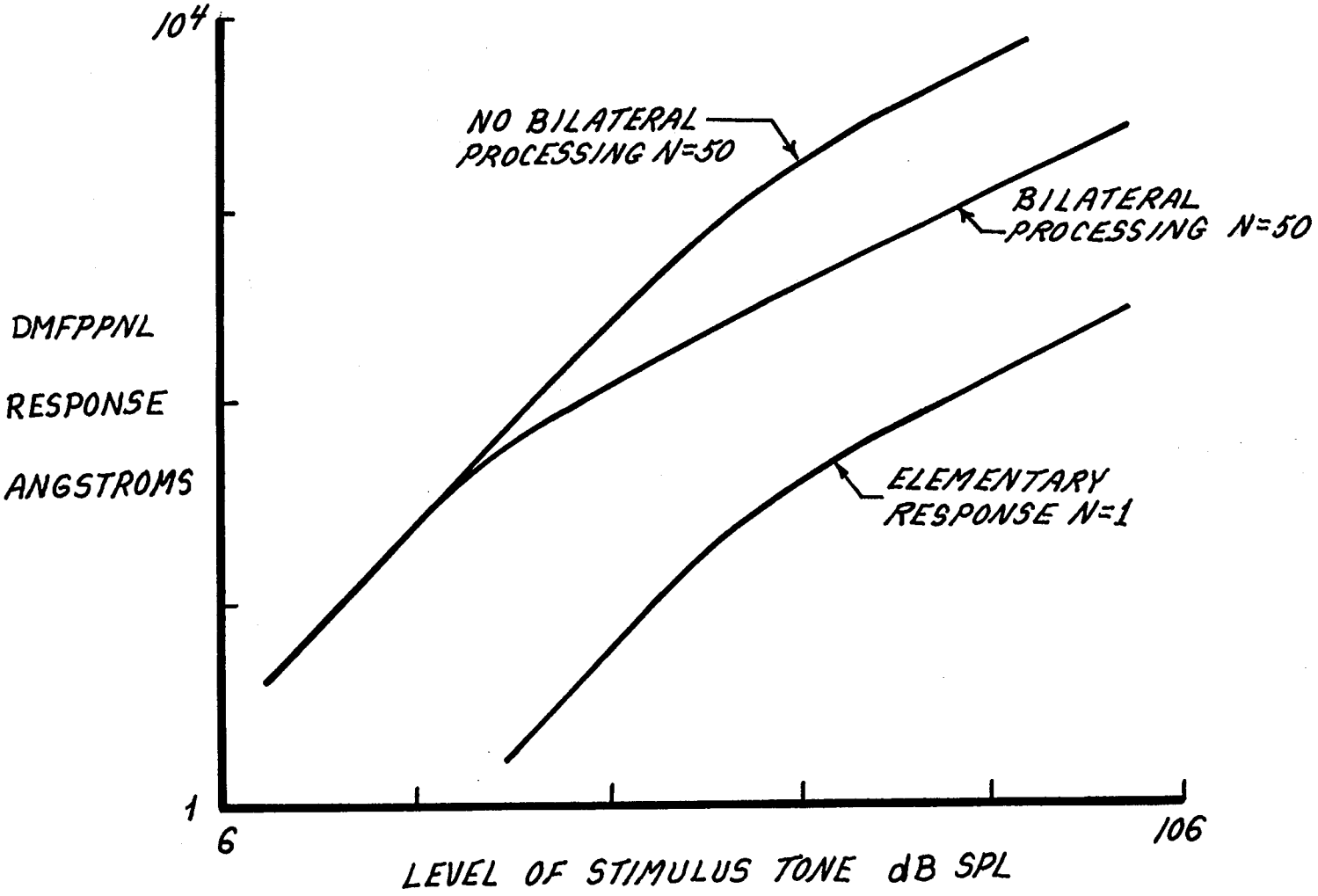
FIG. 6 is a graph detailing the measured response of the present invention.
Figure 7A:
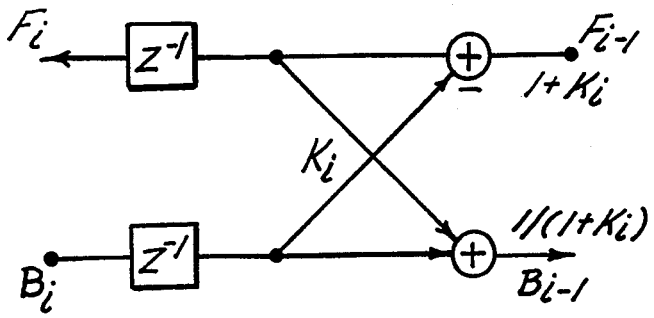
Figure 7B:
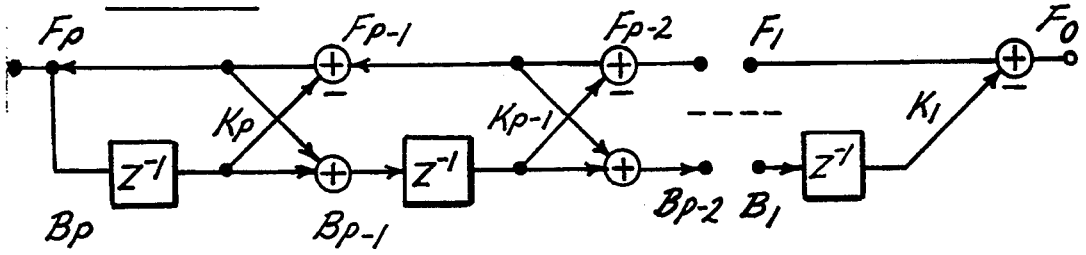

As shown in FIG. 3, the inventor has extended this non-linear amplification principle to include a basilar membrane as a propagating medium which allows for the interaction between the sensed response of organ of Corti filters tuned to different frequencies. As shown therein, a plurality of tip filters H1 are each tuned to a different center frequency $CF_i$ which are then non-linearly coupled for bilateral processing to the basilar membrane. The measured responses are thus the result of a distributed non-linear amplifying effect. This bilateral signal processing is further exemplified by the double headed arrows connecting the cochlea (comprising the organ of Corti and basilar membrane) with the middle ear and outer ear. This model closely parallels the actual physical construction of the cochlea and hence provides a model for construction of an electronic simulator for the cochlea. Of course, electronic circuitry simulating the middle ear and outer ear are well known in the art. See, for example, Chassaing R. and Horning D. W., (1990) *Digital Signal Processing with the TMS* 320C25; and Lin, Kun-Shan, Ed. (1987) *Digital Signal Processing Applications with the TMS* 320 *Family*, Vol. 1. The effect of bilateral processing is shown in FIG. 6 to bring the response curve more into conformance with measured response for the ear.

Figure 4:
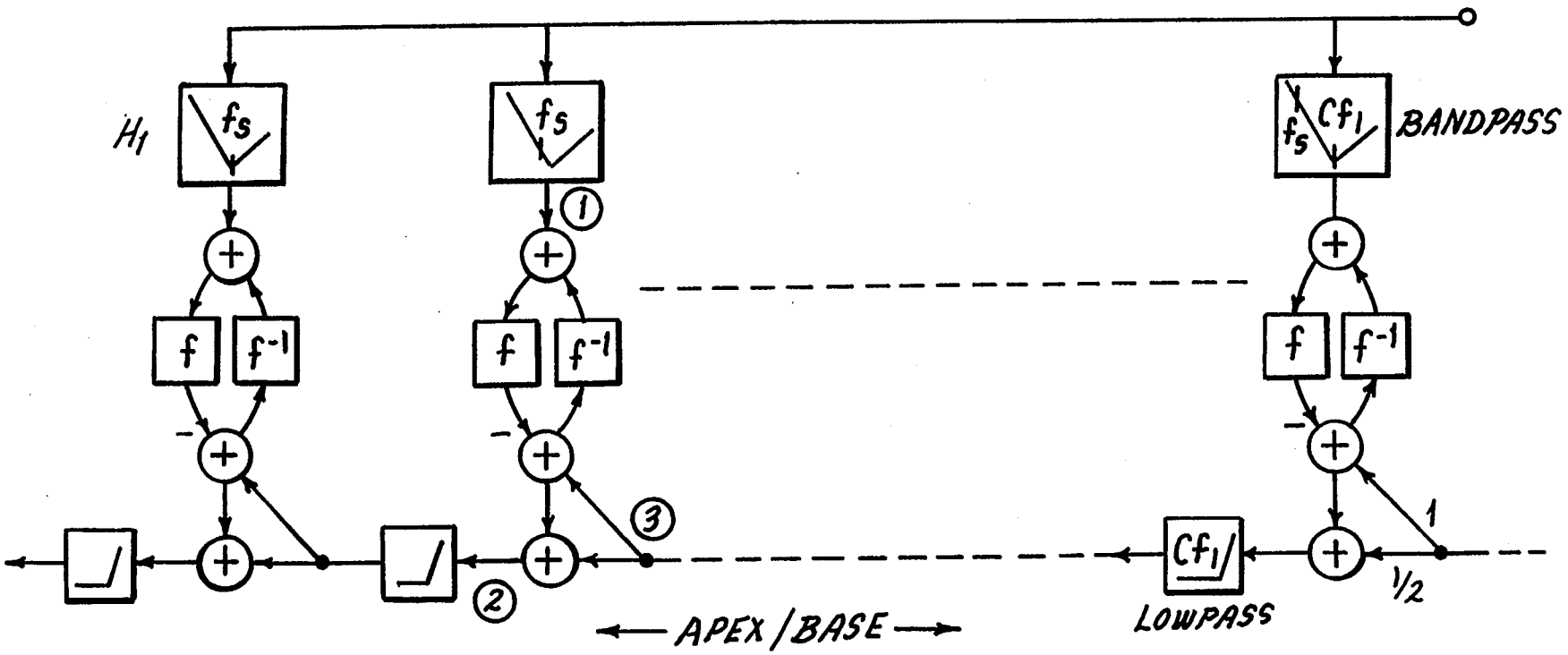
FIG. 4 depicts a schematic representation of an idealized example based upon in-phase addition of apically propagating "tip" responses.

As shown in FIG. 4, an idealized example is presented wherein a plurality of band pass filters having a center frequency $CF_1$ provide a response to an input frequency $F_S$ which is then non-linearly processed and summed along the apex or base, through a series of low pass filters.

A more physically realizable representation and embodiment for the present invention is shown in FIG. 5. As depicted therein, a pair of matched lattices comprising a tip line lattice and a tail line lattice are interconnected by a plurality of tip modules (as shown in FIG. 2) to provide non-linear bilateral signal processing therebetween at different frequency points. The tip line and tail line lattice are conventional all pole lattices as shown in FIG. *7b*. As shown in FIG. *7a*, a one pole lattice representing an idealized section of a non-uniform acoustic tube has $F_i$ and $B_i$ as its forward and backward waves. A unit delay $Z^{-1}$ equals the transit time of the section. $K_i$ is the reflection coefficient that depends upon the ratio of cross-sectional areas of the idealized successive sections. For the all pole lattice as shown in FIG. *7b*, and as used as the tip line and tail line lattices of FIG. 5, the forward delay is eliminated and the backward delay corresponds to twice the transit time. The scaling factor for each section is normalized to unity. Except for the scale factor and delay, the form of the frequency response is unchanged, as demonstrated therein.

As shown in FIG. 5, the responses interact along the tail line lattice much as is believed to be the case in the basilar membrane of the human ear. Similarly, the non-linearly coupled tip line lattice and differentiator D(Z) provide a phase-matched filter-bank sound analysis that is believed to simulate the action of the outer hair cells and adjoining structures comprising the organ of Corti. Thus, the model, as shown in the preferred embodiment of FIG. 5, has some correspondence to the physical properties of the cochlea and hence provide added insight into the actual physical mechanisms at work in the cochlea.

As shown in FIG. 9, this correlation between the model of the present invention and the cochlea itself leads to adjustments in the model which may be used to simulate responses measured in the human ear. For example, the filter responses of the tip line lattice must be normalized to the "center frequency" of each tip filter or tip module. In this event, losses in sensitivity of each of these tip filters or modules may be simulated by choosing a scaling factor alpha such that $0 \leqq \propto \leqq 1$. This scaling factor may be used to adjust the output at the "center frequency", corresponding to the response, as would be the case in the response of a damaged cochlea. Similarly, efferent neural control of the tip sensitivity can be simulated by providing a quiescent bias control at each of the tip modules, as shown. This efferent neural control is representative of the brain's ability to suppress the response of the ear to undesirable sounds and to also simulate the results of inattentiveness, as when a person is listening but not hearing. Coupling of the backward propagation to the tip line from the tail line can be controlled by choosing beta such that $0 \leqq \beta \leqq 1$. Similarly, the tip preamplifier G may have its gain adjusted to correspond to the number of tip couplers used in implementing the simulator. This is shown in FIG. 8 which allows that number to be as large as the 12,000 outer hair cells of the organ of Corti. As shown in FIG. 8, 600 represents five percent of these hair cells. For example, 400 tip couplers can be uniformly spaced over the whole basilar membrane, whereupon G=19. Or, the 400 tip couplers can be "zoomed" onto one 5% region, whereupon G=1. This can result in reduced simulator complexity and cost in order to provide a model which simulates this response.

The invention was demonstrated using VLSI simulation technology. The preferred embodiment is the recommended implementation. VLSI simulation required a powerful general purpose computer, while the inventor considers DSP technology more practical.

It is understood that other technology may be used to implement the invention. Also, one of ordinary skill in the art, knowing the desired non-linear response as included in the tip couplers, could readily design and implement a custom DSP chip for interconnecting the two all pole lattices.

There are various changes and modifications which may be made to the invention as would be apparent to those skilled in the art. However, these changes or modifications are included in the teaching of the disclosure, and it is intended that the invention be limited only by the scope of the claims appended hereto.

What is claimed is:

1. In a sound analyzer having means for receiving a complex sound input comprised of a plurality of frequencies and means for producing an output representative of the frequency response of a human ear, the improvement comprising said output means having means for producing acoustical distortion products as demonstrated to emanate from the human ear.

2. The sound analyzer of claim 1 wherein said output means has means for producing spontaneous emissions as demonstrated to emanate from the human ear.

3. The sound analyzer of claim 2 wherein said output means has means for producing an output which simulates the non-linear interaction between said spontaneous emissions and external sounds as demonstrated to occur in the human ear.

4. In a sound analyzer having means for receiving a complex sound input comprised of a plurality of frequencies and means for producing an output representative of the frequency response of a human ear, the improvement comprising means for varying the sensitivity of said analyzer in response to non-linear bilateral signal processing between said input and said output with respect to each of said plurality of frequencies of said complex sound input to thereby adjust said output.

5. The sound analyzer of claim 4 wherein said output comprises a plurality of discrete outputs, each of said outputs being representative of said frequency response at a pre-selected frequency, and said sensitivity varying means comprises varying the number of discrete outputs over a particular frequency range.

6. The sound analyzer of claim 5 wherein said sensitivity varying means further comprises means associated with each of said discrete outputs for varying the strength of said output.

7. The sound analyzer of claim 6 further comprising means for selectively attenuating the output at all frequencies.

8. In a sound analyzer having means for receiving a complex sound input comprised of a plurality of frequencies and means for producing an output representative of the frequency response of a human ear, the improvement comprising a non-linear, additive, directional wave amplifier means so that said plurality of frequencies may be added in proper time sequence at different locations within said output producing means, said amplifier means being connected between said receiving means and said output producing means.

9. The sound analyzer of claim 8 wherein said amplifier means comprises a pair of matched all pole lattices.

10. The sound analyzer of claim 9 wherein said amplifier means further comprises a plurality of non-linear couplers interconnected between said pair of lattices.

11. The sound analyzer of claim 10 wherein said output means comprises a plurality of taps into one of said lattices, each of said taps providing an output at a particular frequency.

12. The sound analyzer of claim 11 further comprising means for selecting the number of taps and means for selecting the frequency of the output at each of said taps to thereby adjust the sensitivity and frequency range of said sound analyzer.

13. The sound analyzer of claim 12 wherein one of said lattices has means for propagating a signal in two directions therethrough.

14. The sound analyzer of claim 13 wherein said one lattice having means for propagating a signal in two directions is closer to said input than said other lattice.

15. The sound analyzer of claim 14 wherein said lattice having a plurality of taps utilizes propagation of signals in only one direction.

16. The sound analyzer of claim 15 further comprising a variable-gain preamplifier interconnected between said lattices.

17. The sound analyzer of claim 16 further comprising an outer ear circuit connected to an inner ear circuit, with the output of said inner ear circuit being connected to each of said lattices.

18. In a sound analyzer having means for receiving a complex sound input comprised of a plurality of frequencies and means for producing an output representative of the frequency response of a human ear, the improvement comprising means for processing signals in both directions between input and output.

19. The sound analyzer of claim 18 wherein said signal processing means includes means for non-linearly amplifying said signals.

* * * * *